US008231125B2

(12) United States Patent
Hendle et al.

(10) Patent No.: US 8,231,125 B2
(45) Date of Patent: Jul. 31, 2012

(54) DEVICE FOR CONVEYING SHEETS THAT COMPRISES A SHEET DIRECTING ELEMENT

(75) Inventors: Thomas Hendle, Lausanne (CH); Gerald Josef Reinhard, Sulzfeld (DE)

(73) Assignee: KBA-Notasys SA, Lausanne (CH)

( * ) Notice: Subject to any disclaimer, the term of this patent is extended or adjusted under 35 U.S.C. 154(b) by 2386 days.

(21) Appl. No.: 10/504,488

(22) PCT Filed: Jan. 20, 2003

(86) PCT No.: PCT/DE03/00136

§ 371 (c)(1),
(2), (4) Date: Jan. 27, 2005

(87) PCT Pub. No.: WO03/070465

PCT Pub. Date: Aug. 28, 2003

(65) Prior Publication Data

US 2005/0127595 A1 Jun. 16, 2005

(30) Foreign Application Priority Data

Feb. 20, 2002 (DE) ..... 102 07 073

(51) Int. Cl.
*B65H 29/04* (2006.01)

(52) U.S. Cl. ..... 271/204; 271/3.24; 271/277; 271/82; 271/264

(58) Field of Classification Search ..... 271/204, 271/3.24, 277, 82, 264
See application file for complete search history.

(56) References Cited

U.S. PATENT DOCUMENTS

| | | | | |
|---|---|---|---|---|
| 4,083,556 | A * | 4/1978 | Schilling et al. | 271/204 |
| 4,305,331 | A * | 12/1981 | Colapinto | 101/123 |
| 5,263,415 | A * | 11/1993 | Pollich | 101/232 |
| 5,797,321 | A * | 8/1998 | Shibata | 101/246 |
| 6,135,026 | A * | 10/2000 | Kalbantner et al. | 101/232 |
| 6,176,482 | B1 * | 1/2001 | Reinhard et al. | 271/227 |
| 6,241,238 | B1 * | 6/2001 | Aoki | 271/183 |
| 6,746,014 | B2 * | 6/2004 | Endo et al. | 271/204 |

FOREIGN PATENT DOCUMENTS

| | | |
|---|---|---|
| EP | 0 820 864 B1 | 1/1998 |
| EP | 0 892 754 B1 | 1/1999 |
| EP | 1 231 057 A1 | 8/2002 |

* cited by examiner

*Primary Examiner* — Kaitlin Joerger
*Assistant Examiner* — Prasad Gokhale
(74) *Attorney, Agent, or Firm* — Seager, Tufte & Wickhem, LLC

(57) ABSTRACT

The invention relates to a sheet guide element for use in an apparatus for transporting sheets by means of a gripper system having at least two grippers spaced apart from each other and a sheet guide surface defined by the sheet guide element. Here, the sheet guide element is provided with depressions in the sheet guide surface, running parallel to the transport direction, at least in some sections, in order at least partially to accommodate the grippers, so that the sheet guide surface described by the sheet guide element in the transport direction runs, at least in some sections, at the same height as the movement path of the sheet leading edge fixed in the gripper system.

38 Claims, 4 Drawing Sheets

DEVICE FOR CONVEYING SHEETS THAT COMPRISES A SHEET DIRECTING ELEMENT

BACKGROUND OF THE INVENTION

The invention relates to an apparatus for transporting sheets with a sheet guide element according to the preamble of claim 1, 4 or 5.

EP 08 92 754 B1 discloses apparatuses for transporting and guiding sheets by means of a gripper system and a sheet guide element in combination with an assessment system for quality control in sheet-fed rotary presses for printing securities.

A sheet to be assessed is clamped by its sheet leading edge in grippers of the gripper system and moved by the latter along a transport direction into a position in which the quality control is carried out. The transport path of the sheet leading edge is in this case defined by the movement path of the gripper system. In order to guide the sheet, use is made of a sheet guide element, on which the part of the sheet to be inspected is intended to come to lie, as completely and flatly as possible, with no corrugations or folds, at the time of the qualitative assessment.

DE 697 01 173 T2 shows a paper guide apparatus for a sheet-fed offset press, with a guide plate. This guide plate has depressions which extend in the transport direction and into which the grippers dip.

SUMMARY OF THE INVENTION

The invention is based on the object of providing an apparatus for transporting sheets with a sheet guide element.

According to the invention, the object is achieved by the features of claim 1, 4 or 5.

The advantages that can be achieved with the invention are in particular that the sheet guide element is provided with depressions running parallel to the transport direction, at least in some sections, in order at least partially to accommodate the grippers. This achieves the situation where the sheet guide surface described by the sheet guide element runs, at least in some sections, at the same height as the transport path of the sheet leading edge defined by the gripper movement path, and therefore the sheet leading edge also comes to lie flatly on the sheet guide surface. The depressions machined into the sheet guide surface are configured in particular such that, at the recording time, that is to say in the sheet transport position in which the quality control of the sheet is carried out by the inspection system, the sheet comes to lie completely flatly and without corrugations on the sheet guide surface defined by the sheet guide element. This means that, at the recording time, the sheet is arranged reproducibly in its position opposite the inspection system. This ensures that the inspection system, whose mode of action is matched to the distance from the sheet guide element, can carry out the quality control of the entire printed sheet reproducibly and without faults.

In principle, the manner in which the depressions are formed in the sheet guide surface is arbitrary. According to a preferred exemplary embodiment of the invention, the depressions in the sheet guide surface, viewed in the transport direction, begin only from a specific position and run as far as the end of the sheet guide surface. This means that, from the transport position, in which the sheet leading edge clamped in the grippers and the sheet guide surface are at the same height, the part of the sheet which is located in the region of overlap with the sheet guide surface comes to lie on the latter completely and flatly, with no corrugations or folds.

Likewise, it is possible to provide the sheet guide surface along the entire transport direction with depressions running in parallel for the partial accommodation of the grippers of the gripper system. This has the advantage that, along the entire transport movement, the grippers of the gripper system can dip into the plane of the sheet guide surface to such an extent that the sheet leading edge clamped in the grippers is located at the same height as the sheet guide surface along the entire movement path. This again means that, during the entire transport movement, the part of the printed sheet which overlaps the sheet guide surface comes to lie over its entire area and flatly on the latter.

One preferred embodiment is for the sheet guide surface formed by the sheet guide element to approach the transport path of the sheet leading edge continuously. For this purpose, the sheet guide surface of the sheet guide element is provided, at least in some sections, with depressions to accommodate the grippers of the gripper system. From the sheet transport position at which the grippers have dipped into the depressions of the sheet guide surface to such an extent that the transport path of the sheet leading edge is located at the same height as the sheet guide surface, all of the part of the printed sheet guided by the sheet guide surface comes to lie on the sheet guide surface completely and flatly, with no corrugations or folds.

Whether the sheet guide surface of the sheet guide element is curved in the transport direction or not is not important in the basic function of the invention. In a preferred exemplary embodiment, the sheet guide surface is curved concavely or describes a concave circular arc segment in the transport direction. If, in particular, the printed sheet comes to lie completely and flatly on the circular arc-shaped sheet guide surface, each point of the sheet is at the same distance from the center of the circular arc segment along the transport direction. If, for the quality control of sheets, an inspection system is used which needs a constant distance between inspection system and printed sheet for fault-free operation, then it is particularly advantageous to arrange the inspection system at the center of the circular arc segment described by the sheet guide surface.

In constructional terms, the sheet guide element can be designed as a sheet guide plate and the depressions can be formed by cutouts in the sheet guide plate. In this way, a sheet guide surface can be produced in an economical manner.

In order to increase the stability of the sheet guide element designed as a sheet guide plate, it is expedient to provide the sheet guide plate on the rear side, at least in some sections, with reinforcing ribs running longitudinally and/or transversely.

In principle, it is also possible to form the sheet guide element as a sheet guide board, in which the depressions are formed by grooves in the sheet guide board.

One advantageous embodiment of the existing invention consists in providing the sheet guide element, at least in some sections, with cutouts shaped like holes for the passage of air and to assign to the sheet guide element configured in this way a suction apparatus, using which a negative pressure can be produced on the sheet guide surface. The flat position of the printed sheet on the sheet guide surface is assisted by means of the negative pressure prevailing on the sheet guide surface. In particular, the printed sheet can be transported and guided on the sheet guide surface counter to its inherent gravitational force, that is to say in a hanging manner.

If the sheet guide element is provided with an adjusting apparatus for position control, accurate fine positioning of the sheet guide element in the apparatus for transporting and guiding sheets can be carried out as a result. This is advantageous in particular when the apparatus for transporting and guiding sheets is arranged opposite an inspection system, for whose fault-free function the distance between inspection system and sheet and also the curvature of the sheet to be examined has to be set very accurately.

In a preferred embodiment, an optical inspection system for the quality control of sheets is arranged opposite the sheet guide surface.

BRIEF DESCRIPTION OF THE DRAWINGS

Exemplary embodiments of the invention are illustrated in the drawings and will be described in more detail in the following text.

In the drawings.

DETAILED DESCRIPTION OF THE EMBODIMENTS

Figure 1:
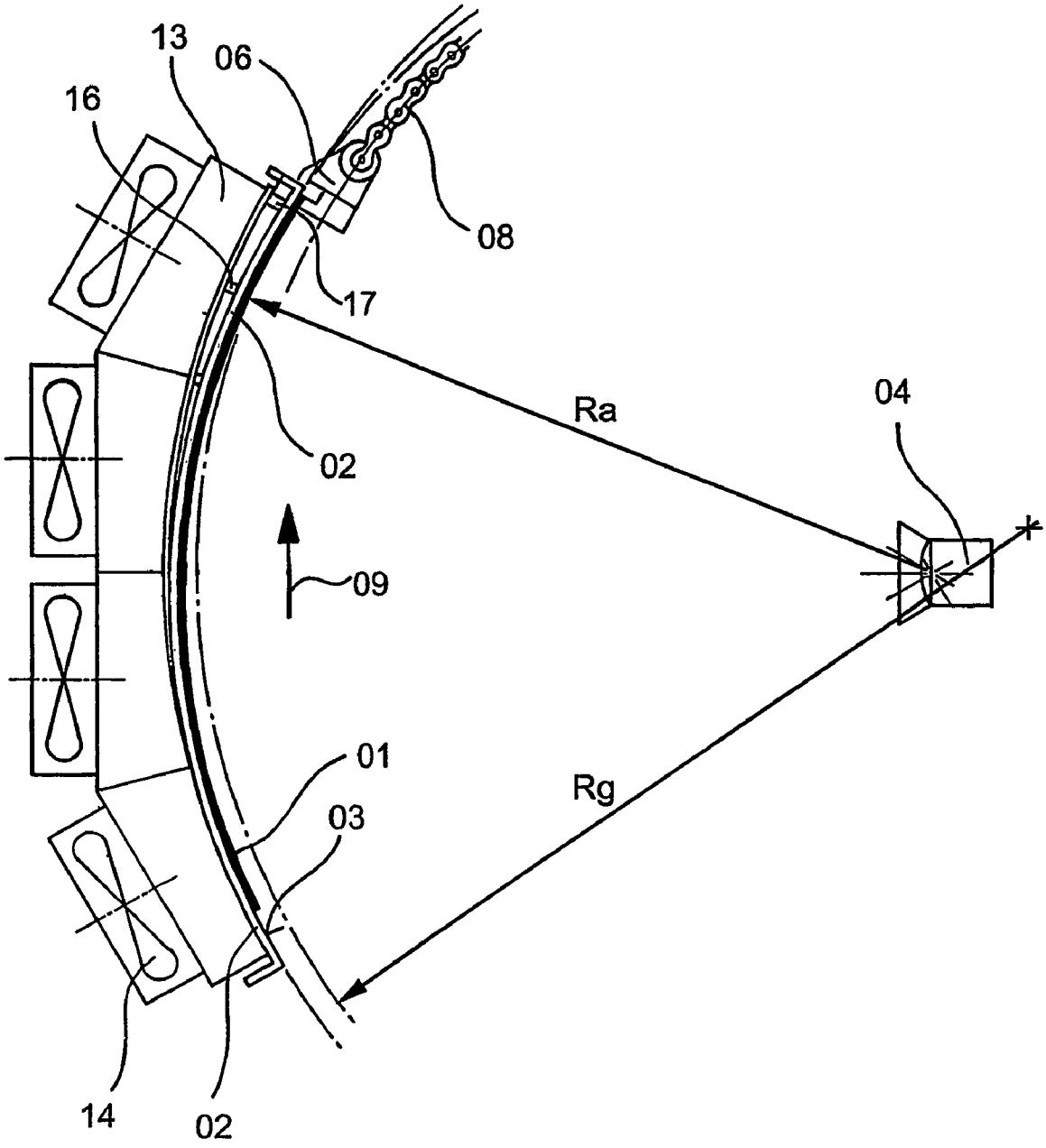
FIG. 1 shows an apparatus for transporting and guiding sheets with a sheet guide element and an inspection system arranged opposite for the quality control of printed sheets in the schematically illustrated cross section.

In FIG. 1, a quality control system with a sheet guide element 02 is shown in the sheet transport position, in which the assessment of the sheet 01 is carried out. For the purpose of qualitative assessment of sheets 01, at least at the assessment time, the part of the sheet 01 to be tested must be arranged reproducibly in terms of distance and curvature and with no corrugations or folds opposite the inspection system 04. Furthermore, the sheet guide surface 03 of the sheet guide element 02 has to be designed in such a way that it is matched to the requirements of transmitter and receiver of the inspection system 04 in terms of position and shape. A quality control system for the qualitative assessment of sheets 01 substantially comprises a sheet guide surface 03 formed by a sheet guide element 02, a transport device, which is assembled from a gripper system 07 (see FIG. 2) with grippers 06 and a chain conveyor 08, and an inspection system 04. Such a quality control system is used, inter alia, in the quality control of printed sheets in a rotary press, such as in a sheet-fed rotary press for securities.

A sheet 01 to be inspected is clamped in the grippers 06 of the gripper system 07 at its leading edge and transported in the transport direction 09. The gripper system 07 is fixed to circulating chains of a chain conveyor 08 known per se. In the present exemplary embodiment, the movement path of the sheet leading edge fixed in the grippers 06 of the gripper system 07 is described by a circular arc segment with radius Rg. The guidance of the sheet 01 moved in the transport direction 09 is accomplished by a sheet guide element 02, on whose sheet guide surface 03 the sheet 01 comes to lie. In the present exemplary embodiment, the sheet guide element 02 is designed as a sheet guide plate 02. The sheet guide surface 03 of the sheet guide element 02 describes a circular arc segment with radius Ra, whose concave side faces the inspection system 04. Furthermore, the inspection system 04 is arranged at the center of the circular arc segment of the sheet guide surface 03. It follows from this that, in the present exemplary embodiment, the shape of the sheet guide surface 03 and the position of the sheet guide surface 03 in relation to the inspection system 04 is matched to the requirements of a scanning system 04, which, for fault-free functioning, needs a constant distance from the sheet 01 to be examined.

In the plan view (see FIG. 2), the sheet guide surface 03 of the sheet guide plate 02 shows depressions 11 running parallel to the transport direction 09 for the partial accommodation of the grippers 06, which depressions begin only from a specific position on the sheet guide surface 03 and run as far as the end of the sheet guide surface 03. Likewise, the sheet guide surface 03 of the sheet guide plate 02 is designed with cutouts 12 shaped like holes for the passage of air.

Figure 3:
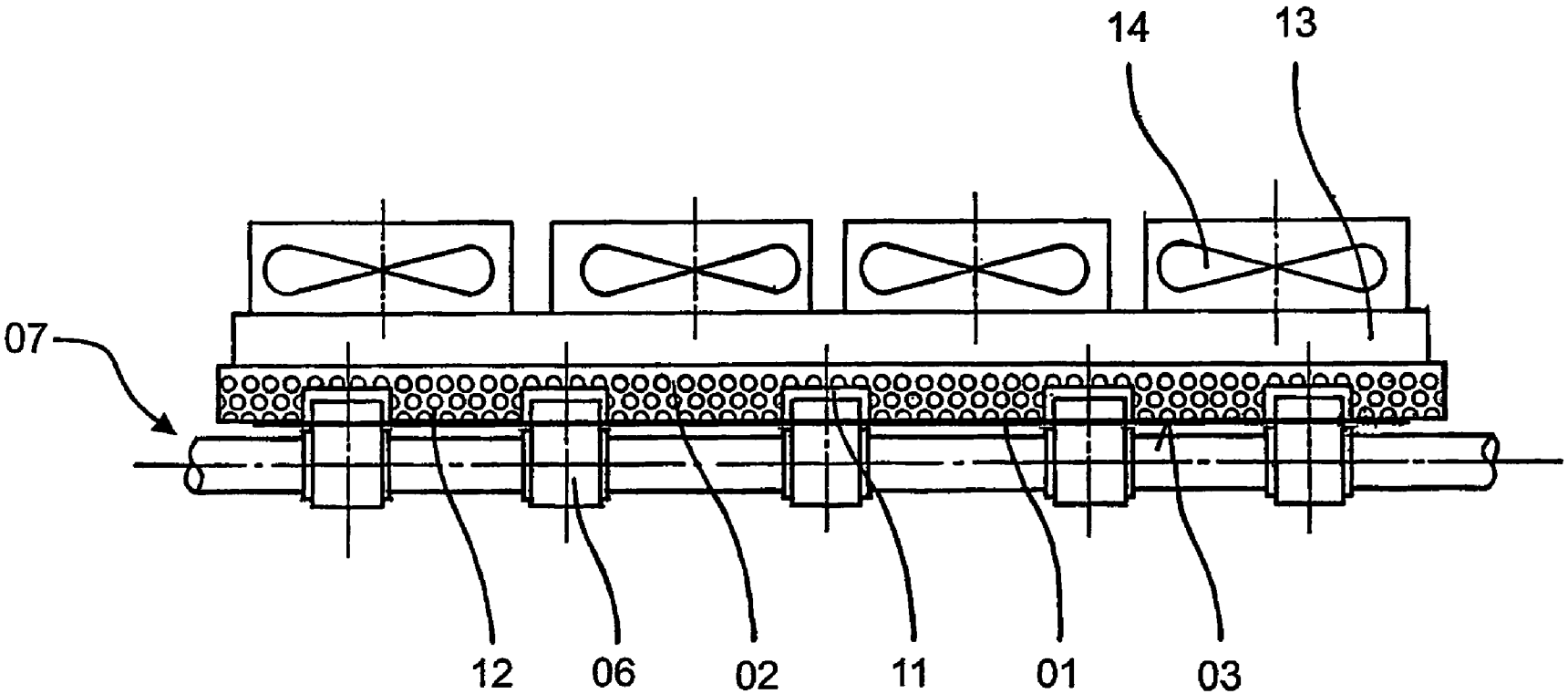
FIG. 3 shows the apparatus according to FIG. 1 in front view.

On the rear side, the sheet guide plate 02 is assigned a suction apparatus comprising suction box 13 and fans 14 (see FIGS. 1 and 3). By means of the suction apparatus, a negative pressure is produced on the sheet guide surface 03 of the sheet guide plate 02.

The sheet guide plate 02 is arranged in such a way that the sheet guide surface 03 continuously and progressively approaches the movement path of the sheet leading edge clamped in the grippers 06. As viewed in the transport direction 09, the sheet guide plate 02 at its start rests on a surface of the suction box 13 that faces the sheet guide plate 02 and moves away from said surface in the transport direction 03. This means that the end of the sheet guide plate 02 has no direct contact with the suction box 13. In order to increase the dimensional stability of the sheet guide element 02 designed as a sheet guide plate 02, reinforcing ribs 16 are fitted to the rear side of the sheet guide plate 02. It is also entirely possible for the reinforcing ribs 16 shown in FIG. 1 to function simultaneously as spacers between suction box 13 and sheet guide plate 02 or, in addition to the reinforcing ribs 16 or instead of the reinforcing ribs 16, for spacers to be fitted to the rear side of the sheet guide plate 02, in order to achieve the desired course of the sheet guide surface 03.

The exact position of the sheet guide surface 03 in relation to the inspection system 04 can be accomplished by means of an adjusting apparatus for position control 17. This can be an important feature, in particular when the apparatus for transporting and guiding sheets 01 is assigned an inspection system 04 which, in terms of its function, reacts sensitively to the distance and curvature of the sheet 01 to be examined.

Once the sheet leading edge, as viewed in the transport direction 09, is in the initial or central region of the sheet guide surface 03, the sheet leading edge clamped in the grippers 06 is at a different height than that part of the sheet 01 resting on the sheet guide surface 03. It follows from this that a certain part of the sheet 01, which adjoins the sheet leading edge, does not come to lie on the sheet guide surface 03.

As can be seen from FIG. 1, at the end of the transport movement, the movement path of the sheet leading edge in the transport direction 09 is described by a circular arc segment with radius Rg, at the same height as the sheet guide surface 03, which in the transport direction 09 is described by a circular arc segment with radius Ra. At this point, the sheet guide surface 03 and movement path of the sheet leading edge intersect. In the present exemplary embodiment, this point of intersection is the same as the end edge of the sheet guide surface 03 of the sheet guide plate 02.

In this transport position, the sheet 01 rests on the sheet guide surface 03 completely and flatly, with no corrugations or folds, from the start of the sheet guide surface 03 as far as the end of the latter. This is the transport position, in which a qualitative inspection of the sheet 01 can be carried out by the inspection system 04, since the sheet 01 now rests reproducibly on the sheet guide surface 03 with no corrugations or folds opposite the inspection system 04. This means that, by means of the inspection system 04, which, in terms of its mode of action, is matched to the curvature and distance from the sheet guide surface 03, the qualitative inspection of the sheet 01 can be carried out reproducibly and without faults.

Figure 2:
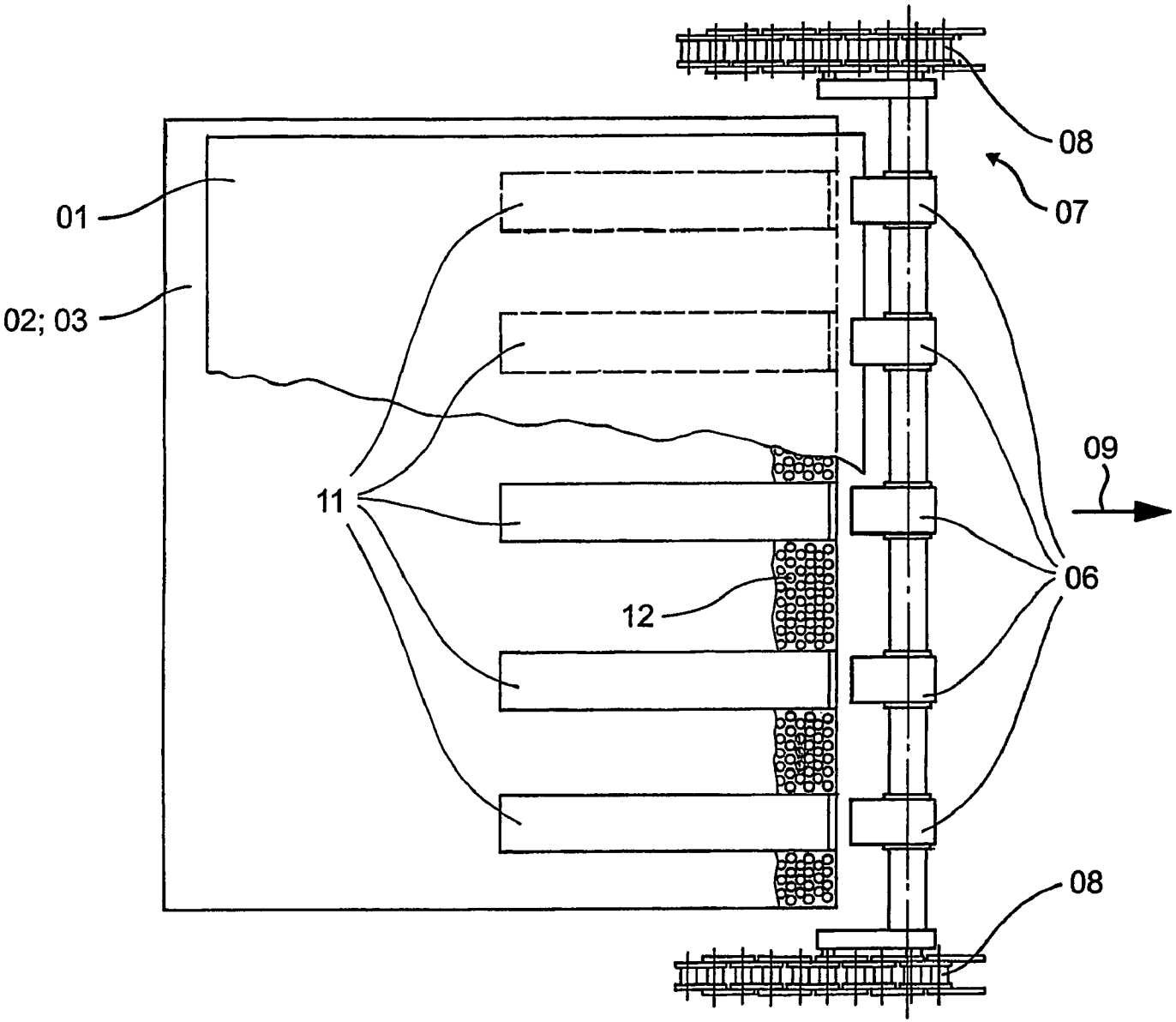
FIG. 2 shows the apparatus according to FIG. 1 in plan view from the position of the opposite inspection system.

During the transport movement of the sheet 01 along the transport direction 09, the grippers 06 of the gripper system 07 approach the sheet guide surface 03 and, on account of depressions 11, can dip into the plane of the sheet guide surface 03 without collision. The depressions 11 in the present exemplary embodiment are formed by cutouts in the sheet guide surface 03 of the sheet guide plate 02. FIG. 2 shows a plan view of the sheet guide plate 02 and the sheet 01 clamped in the grippers 06 of the gripper system 07 from the position of the inspection system 04 arranged opposite.

A front view of the apparatus can be seen in FIG. 3. In the transport position illustrated, the grippers 06 of the gripper system 07 have dipped into the cutouts 11 in the sheet guide surface to such an extent that the leading edge of the sheet 01 clamped in the grippers 06 comes to lie on the entire sheet guide surface 03.

Figure 4:
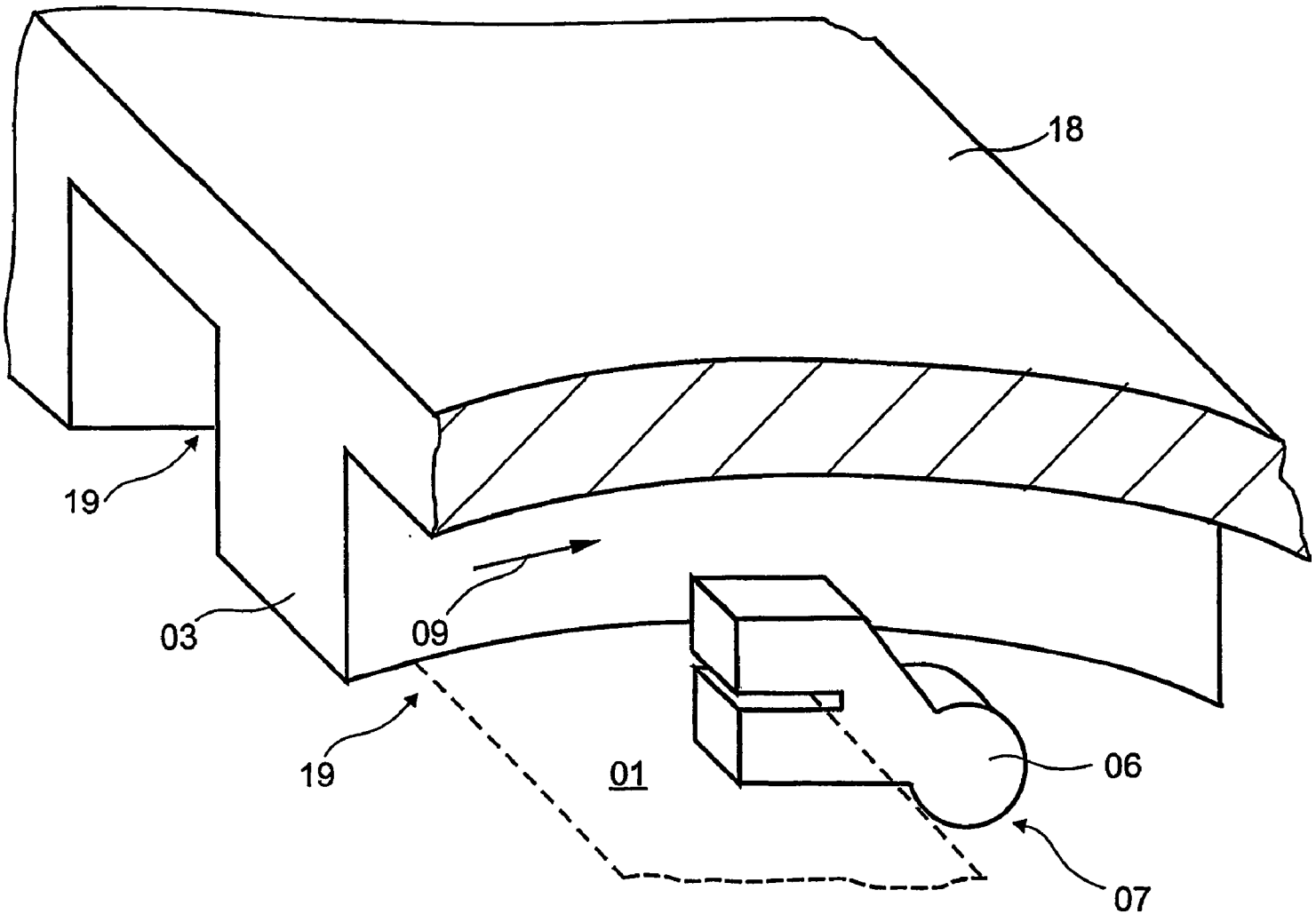
FIG. 4 shows a longitudinal section through a sheet guide element formed as a sheet guide board in the region of a depression with a gripper dipped partly into the plane of the sheet guide surface.

FIG. 4 reveals a longitudinal section in the transport direction 09 through a sheet guide element 18 formed as a sheet guide board 18. The depressions 19 are formed in the shape of grooves 19. A gripper 06 of the gripper system 07 has dipped partly into the groove 19 to such an extent that the sheet leading edge clamped in the gripper 06 is at the same height as the sheet guide surface 03 of the sheet guide board 18 and therefore all of the part of the sheet 01 guided by the sheet guide surface 03 comes to lie completely and flatly on the latter.

The sheet guide element 02; 18 can also be designed as a perforated plate.

LIST OF DESIGNATIONS

01 Sheet
02 Sheet guide element, sheet guide plate
03 Sheet guide surface
04 Inspection system, scanning system
05 -
06 Gripper
07 Gripper system
08 Chain conveyor
09 Transport direction
10 -
11 Depression to accommodate the gripper
12 Cutout shaped like a hole
13 Suction-box
14 Fan
15 -
16 Reinforcing ribs
17 Adjusting apparatus for position control
18 Sheet guide element, sheet guide board
19 Depression, groove
Ra Radius
Rg Radius

The invention claimed is:

1. An apparatus for transporting sheets with a sheet guide element and at least one gripper system for holding sheets by a sheet leading edge thereof, said gripper system having at least two grippers spaced apart from each other and a sheet guide surface defined by the sheet guide element, said sheet guide surface being curved concavely and having a shape of a circular arc, the sheet guide element being provided with depressions in the sheet guide surface, running parallel to the transport direction, at least in some sections, in order at least partially to accommodate the grippers, so that the sheet guide surface described by the sheet guide element in the transport direction runs, at least in some sections, at the same height as the movement path of the sheet leading edge fixed in the gripper system, wherein the sheet guide surface of the sheet guide element approaches the transport plane of the gripper system, as referred to the transport direction, and the grippers are arranged to dip increasingly more deeply into the depressions in the transport direction.

2. The apparatus as claimed in claim 1, wherein the depressions in the sheet guide surface to accommodate the grippers begin only from a specific position and run in the transport direction as far as the end of the sheet guide surface.

3. The apparatus as claimed in claim 1, wherein the sheet guide surface is provided over the entire length with depressions to accommodate the grippers.

4. The apparatus as claimed in claim 1, wherein the sheet guide element is designed as a sheet guide plate and the depressions are formed by cutouts in the sheet guide surface of the sheet guide plate.

5. The apparatus as claimed in claim 4, wherein reinforcing ribs are fitted to the rear side of the sheet guide plate, at least in some sections, in particular running longitudinally and/or transversely with respect to the transport direction.

6. The apparatus as claimed in claim 1, wherein the sheet guide element is designed, at least in some sections, with recesses shaped like holes for the passage of air.

7. The apparatus as claimed in claim 6, wherein the sheet guide element is designed as a perforated plate.

8. The apparatus as claimed in claim 7, wherein the sheet guide element is assigned at least one suction apparatus.

9. The apparatus as claimed in claim 8, wherein the sheet guide element comes to lie, at least in some sections, on a supporting surface of the suction apparatus.

10. The apparatus as claimed in claim 8, wherein the sheet guide element and the suction apparatus are designed as an integral unit.

11. The apparatus as claimed in claim 6, wherein the sheet guide element is assigned at least one suction apparatus.

12. The apparatus as claimed in claim 11, wherein the sheet guide element comes to lie, at least in some sections, on a supporting surface of the suction apparatus.

13. The apparatus as claimed in claim 11, wherein the sheet guide element and the suction apparatus are designed as an integral unit.

14. The apparatus as claimed in claim 1, wherein the sheet guide element is formed as a sheet guide board and the depressions are formed by grooves in the sheet guide surface of the sheet guide board.

15. The apparatus as claimed in claim 1, wherein the sheet guide surface of the sheet guide element along the transport direction is described by a circular arc with radius (Ra), and the movement path in the transport direction of the sheet leading edge clamped in the gripper system is described by a circular arc with radius (Rg), and the two arc segments intersect at a point.

16. The apparatus as claimed in claim 15, wherein the point of intersection is arranged at the end of the sheet guide element in the transport direction.

17. The apparatus as claimed in claim 1, wherein the sheet guide element is provided with an adjusting apparatus for position control.

18. The apparatus as claimed in claim 1, wherein an inspection system is arranged opposite the sheet guide surface.

19. The apparatus as claimed in claim 18, wherein the concavely curved side of the sheet guide surface faces the inspection system.

20. The apparatus as claimed in claim 19, wherein the inspection system is an optical scanning system and the shape of the sheet guide element is matched to the requirements of the optical scanning system.

21. An apparatus for transporting sheets with a sheet guide element and at least one gripper system for holding sheets by a sheet leading edge thereof, the sheet guide element having a sheet guide surface, the sheet guide surface of the sheet guide element approaching the transport plane of the gripper system, as referred to the transport direction, wherein the sheet guide surface of the sheet guide element along the transport direction is described by a first circular arc with radius (Ra), and the movement path in the transport direction of the sheet leading edge clamped in the gripper system is described by a second circular arc with radius (Rg), and the first and second circular arcs intersect at a point.

22. The apparatus as claimed in claim 21, wherein the sheet guide surface of the sheet guide element continuously and progressively approaches the transport plane of the sheet leading edge in the gripper system.

23. The apparatus as claimed in claim 21, wherein the sheet guide element is formed as a sheet guide board and depressions are formed by grooves in the sheet guide surface of the sheet guide board.

24. The apparatus as claimed in claim 21, wherein the sheet guide surface is curved concavely.

25. The apparatus as claimed in claim 21, wherein the sheet guide element is designed as a sheet guide plate and depressions are formed by cutouts in the sheet guide surface of the sheet guide plate.

26. The apparatus as claimed in claim 25, wherein reinforcing ribs are fitted to the rear side of the sheet guide plate, at least in some sections, in particular running longitudinally and/or transversely with respect to the transport direction.

27. The apparatus as claimed in claim 21, wherein an inspection system is arranged opposite the sheet guide surface.

28. The apparatus as claimed in claim 27, wherein a concavely curved side of the sheet guide surface faces the inspection system.

29. The apparatus as claimed in claim 28, wherein the inspection system is an optical scanning system and the shape of the sheet guide element is matched to the requirements of the optical scanning system.

30. The apparatus as claimed in claim 21, wherein the sheet guide element is designed, at least in some sections, with recesses shaped like holes for the passage of air.

31. The apparatus as claimed in claim 30, wherein the sheet guide element is designed as a perforated plate.

32. The apparatus as claimed in claim 31, wherein the sheet guide element is assigned at least one suction apparatus.

33. The apparatus as claimed in claim 32, wherein the sheet guide element comes to lie, at least in some sections, on a supporting surface of the suction apparatus.

34. The apparatus as claimed in claim 32, wherein the sheet guide element and the suction apparatus are designed as an integral unit.

35. The apparatus as claimed in claim 30, wherein the sheet guide element is assigned at least one suction apparatus.

36. The apparatus as claimed in claim 35, wherein the sheet guide element comes to lie, at least in some sections, on a supporting surface of the suction apparatus.

37. The apparatus as claimed in claim 35, wherein the sheet guide element and the suction apparatus are designed as an integral unit.

38. The apparatus as claimed in claim 21, wherein the sheet guide element is provided with an adjusting apparatus for position control.

* * * * *